US009834292B1

(12) United States Patent
Drozdowski et al.

(10) Patent No.: US 9,834,292 B1
(45) Date of Patent: Dec. 5, 2017

(54) OUTBOARD MOTOR MOUNT AND SIDE-MOUNT ACCESSORY ADAPTER

(71) Applicants: Brian Drozdowski, Brandon, FL (US); Amit Patel, Wesley Chapel, FL (US)

(72) Inventors: Brian Drozdowski, Brandon, FL (US); Amit Patel, Wesley Chapel, FL (US)

(73) Assignee: JL MARINE SYSTEMS, INC, Tampa, FL (US)

( * ) Notice: Subject to any disclaimer, the term of this patent is extended or adjusted under 35 U.S.C. 154(b) by 0 days.

(21) Appl. No.: 14/999,609

(22) Filed: Jun. 3, 2016

(51) Int. Cl.
*F16M 1/00* (2006.01)
*B63H 20/06* (2006.01)
*B63B 27/14* (2006.01)
*B63B 21/24* (2006.01)

(52) U.S. Cl.
CPC ..... *B63H 20/06* (2013.01); *B63B 21/24* (2013.01); *B63B 27/146* (2013.01)

(58) Field of Classification Search
USPC ..... 248/640
See application file for complete search history.

(56) References Cited

U.S. PATENT DOCUMENTS 2,886,462 A * 5/1959 Jagiel ..... B63H 20/08 114/285
4,482,330 A * 11/1984 Cook ..... B63H 20/106 248/640
4,624,438 A * 11/1986 Goodman, Jr. ..... B63H 20/106 248/642
5,170,740 A * 12/1992 Rottschafer ..... B63H 20/36 114/362
5,174,542 A * 12/1992 DeLeeuw, Jr. ..... B63B 7/085 248/224.7
5,293,832 A * 3/1994 Potter, Jr. ..... B63H 20/06 114/343
5,782,662 A * 7/1998 Icenogle ..... B63H 20/106 248/641
5,944,568 A * 8/1999 Rabal ..... B63H 20/106 440/53
5,964,627 A * 10/1999 Detwiler ..... B63H 20/106 440/58
6,132,271 A * 10/2000 Hebert ..... B63H 20/106 440/53
6,378,833 B1 * 4/2002 Ries ..... B63H 20/06 248/640
6,386,740 B1 * 5/2002 Grissom ..... B60Q 1/305 362/396

* cited by examiner

*Primary Examiner* — Monica Millner

(57) ABSTRACT

An outboard motor mount and side-mount accessory adapter to mount an outboard motor and an accessory to the transom of a boat wherein the outboard motor mount includes a transom mounting plate to secure the outboard motor mount to the transom and an adapter mounting plate extending outwardly from the transom mounting plate and wherein the side-mount accessory adapter includes a proximal side-mount adapter mounting plate coupled to the adapter mounting plate and a distal accessory mounting plate to support the accessory thereon.

12 Claims, 5 Drawing Sheets

OUTBOARD MOTOR MOUNT AND SIDE-MOUNT ACCESSORY ADAPTER

BACKGROUND OF THE INVENTION

Field of the Invention

A motor mount assembly to mount an outboard motor and a marine accessory such as an emergency boarding ladder, shallow water anchor, transom wedge kit or water skis to the transom of a boat.

Description of the Prior Art

Currently various marine accessories such as emergency boarding ladders, shallow water anchors and transom wedge kits are mounted to the transom of a boat using the same fasteners or bolts that secure the outboard motor to the transom or jack plate. The dual use of the same fasteners securing both an accessory and the outboard motor to the transom of the boat compromises the ability of the fasteners or bolts to maintain sufficient clamp load.

The use of a boat with loose engine mounting fasteners creates the possibility of performance, durability and/or safety issues for example, loose engine mounting fasteners can cause the transom bracket to fail resulting in a loss of the driver's ability to control the boat which may cause serious personal injury or death. Thus the fasteners that secure the outboard motor to the boat should not be used to attach an accessory to the boat. Further wedges or plates should not be installed between the transom clamp brackets and the transom or jack plate.

Accordingly there is a need for means to safely mount an accessory to the transom of a boat independently or separately from the outboard motor.

SUMMARY OF THE INVENTION

The present invention relates to an outboard motor mount and a side-mount accessory adapter to mount an outboard motor and an accessory to the transom of a boat.

The outboard motor mount comprises a flat transom mounting plate and a flat adapter mounting plate disposed at substantially right angles relative to each other.

A first upper set or pair of countersunk apertures formed in the outer surface of the flat transom mounting plate and a first lower set or pair of countersunk apertures disposed within formed in the outer surface of the flat transom mounting plate are disposed in substantially vertical alignment relative to each other.

A second upper set or pair of countersunk apertures formed in the outer surface of the flat transom mounting plate and a second lower set or pair of apertures formed in the outer surface of the flat transom mounting plate are disposed in substantially vertical alignment relative to each other.

Each set or pair of countersunk apertures comprises an upper fastener receiving hole and a lower fastener receiving hole to receive a motor bolt or fastener and a transom bolt or fastener respectively therethrough.

The flat adapter mounting plate includes an upper set or pair of apertures and a lower set or pair of apertures.

The side-mount accessory adapter comprises a flat proximal side-mount adapter mounting plate including an upper slot and a lower slot formed therethrough to receive adapter bolts or fasteners extending through the lower fastener receiving hole of the upper set or pair of apertures and the lower set or pair of apertures formed through the flat adapter mounting plate to secure the side-mount accessory adapter to the flat adapter mounting plate of the outboard motor mount and a flat distal accessory mounting plate including at least one accessory mounting aperture formed therethrough to attach or mount an accessory to the side-mount accessory adapter.

Prior to installation, the proper length bolts or fasteners needed to fasten the outboard motor to the transom are placed into outboard motor mount. The outboard motor mount is then affixed to the transom with a separate set of bolts or fasteners. The outboard motor is hung on the exposed bolts and fastened to the transom. The side-mount accessory adapted to secure to the outboard motor mount.

A port and starboard outboard motor mount and side-mount accessory adapter may be used. If a single outboard motor mount and side-mount accessory adapter is used, an adapter plate shim may be placed on the opposite side of the outboard motor.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
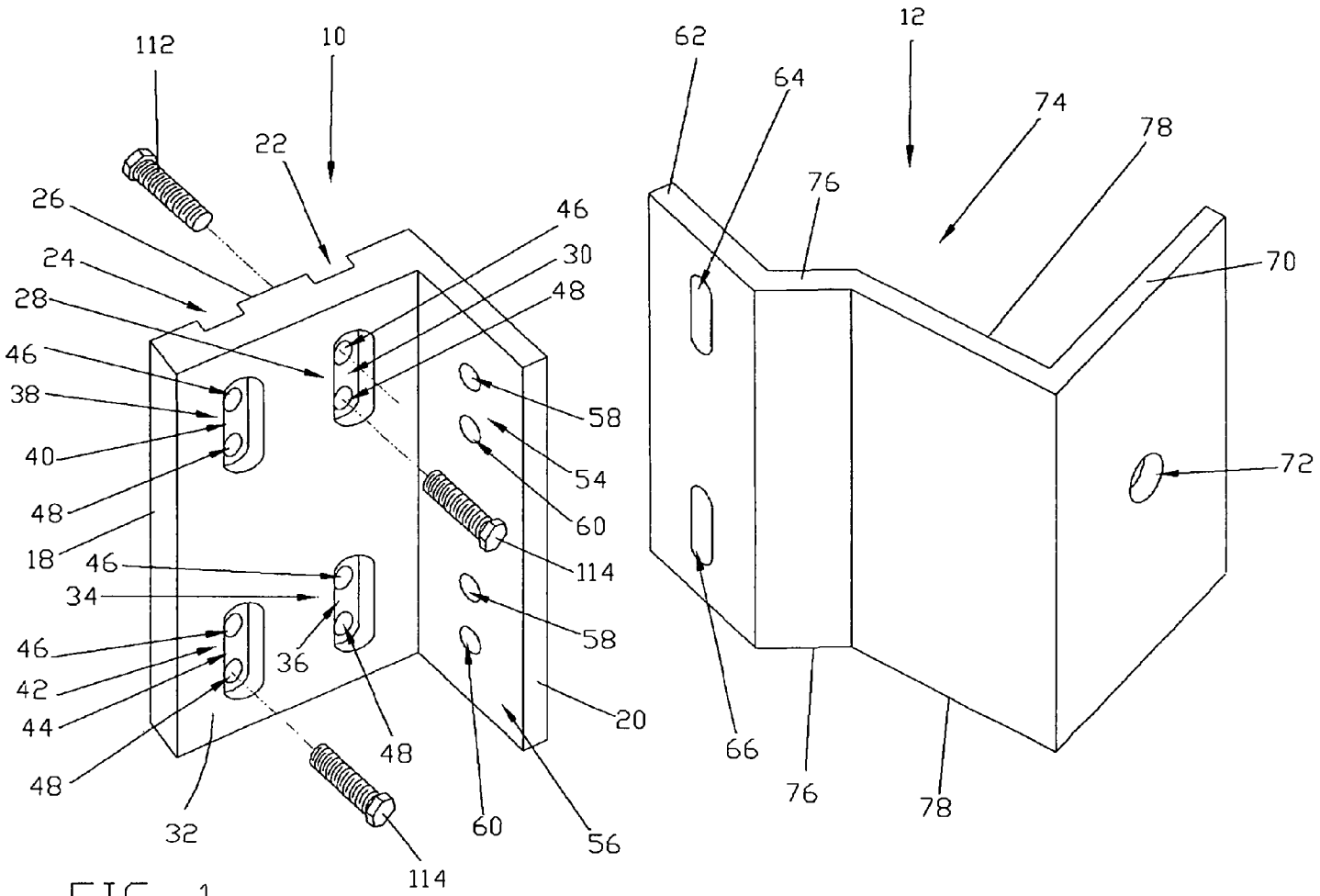
FIG. 1 is a perspective exploded view of the outboard motor mount and side-mount accessory adapter of the present invention.
Figure 2:
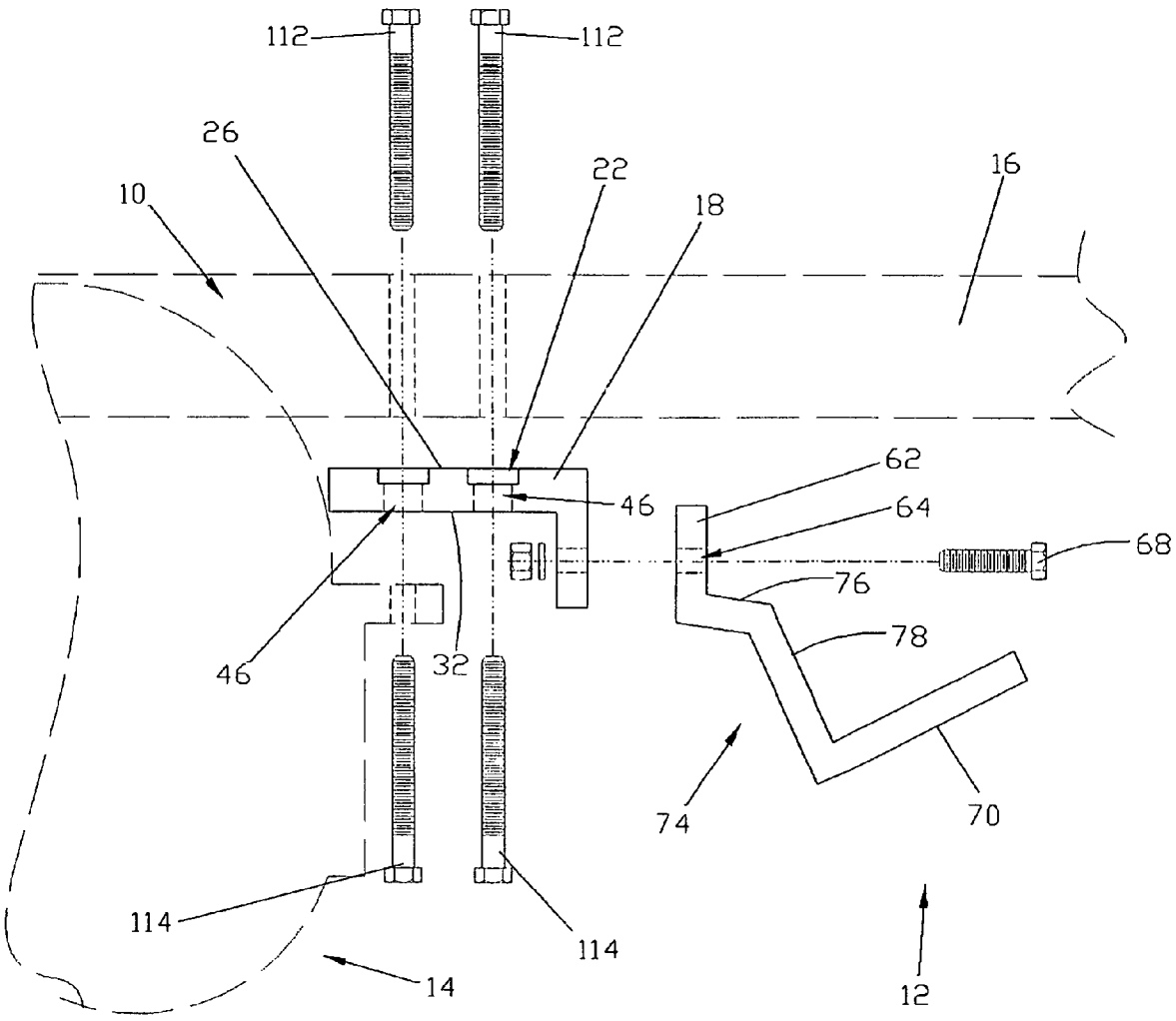
FIG. 2 is a top exploded view of the outboard motor mount and side-mount accessory adapter of the present invention with an outboard motor and transom of a boat.
Figure 3:
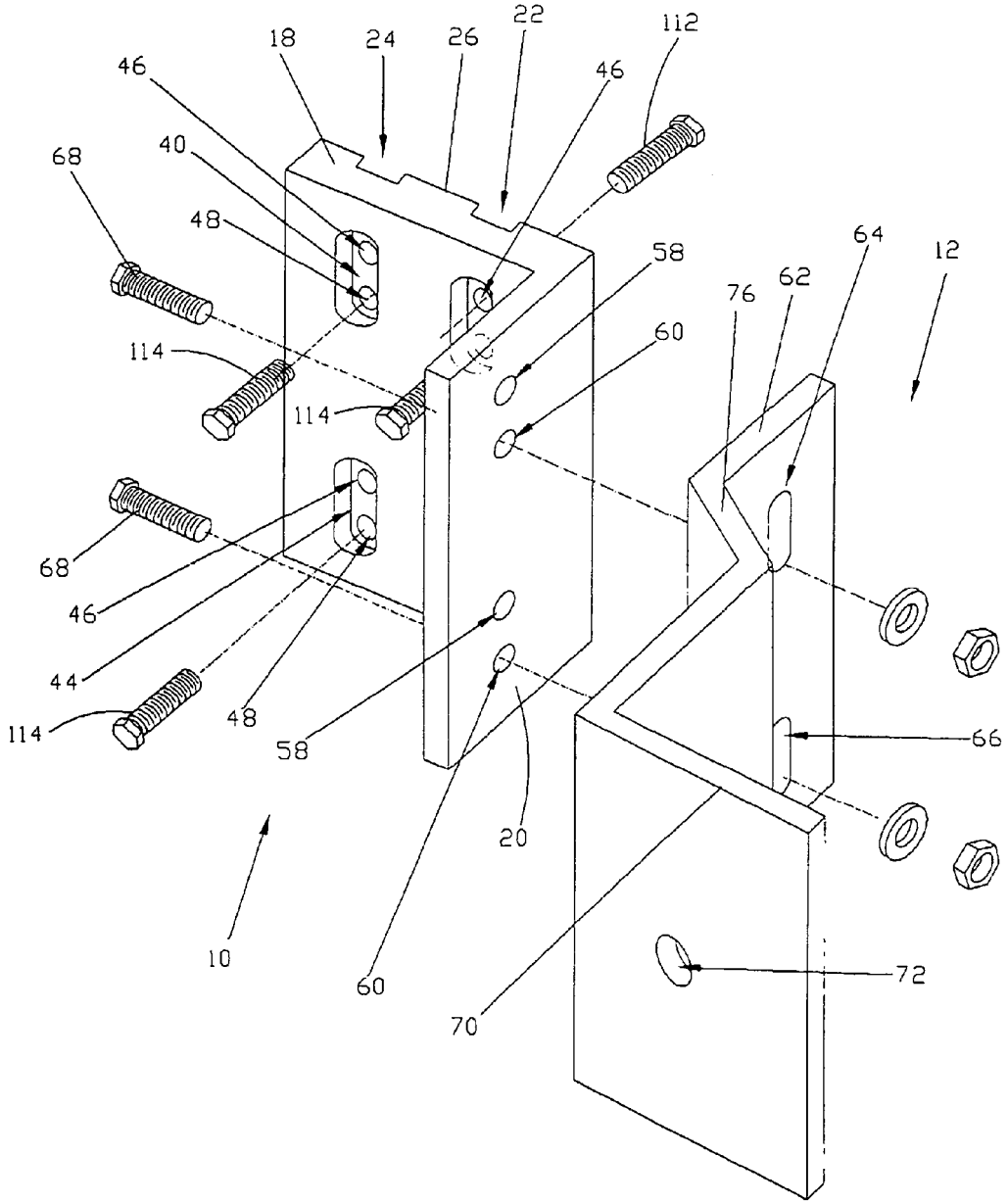
FIG. 3 is a perspective exploded view of the outboard motor mount and side-mount accessory adapter of the present invention.

As shown in FIGS. 1 through 3, the present invention relates to an outboard motor mount generally indicated as 10 and a side-mount accessory adapter generally indicated as 12 to mount an outboard motor generally indicated as 14 and an accessory such as an emergency boarding ladder, shallow water anchor, transom wedge kit or water skis (not shown) to the transom 16 of a boat (not shown).

The outboard motor mount 10 comprises a substantially rectangular flat transom mounting plate 18 and a substantially rectangular adapter mounting plate 20 disposed substantially perpendicular angles relative to each other.

The substantially rectangular flat transom mounting plate 18 includes a first and second substantially parallel longitudinally disposed groove indicated as 22 and 24 respectively formed on the inner surface 26 thereof.

A first upper set or pair of countersunk apertures generally indicated as 28 disposed within a substantially oval first upper recess 30 formed in the outer surface 32 of the substantially rectangular flat transom mounting plate 18 and a first lower set or pair of countersunk apertures generally indicated as 34 disposed within a substantially oval first lower recess 36 formed in the outer surface 32 of the substantially rectangular flat transom mounting plate 18 are disposed in substantially vertical alignment relative to each other.

A second upper set or pair of countersunk apertures generally indicated as 38 disposed within a substantially oval second upper recess 40 formed in the outer surface 32 of the substantially rectangular flat transom mounting plate 18 and a second lower set or pair of countersunk apertures generally indicated as 42 disposed within a substantially oval second lower recess 44 formed in the outer surface 32 of the substantially rectangular flat transom mounting plate 18 are disposed in substantially vertical alignment relative to each other.

Each set or pair of countersunk apertures 28, 34, 38 and 42 comprises an upper fastener receiving hole 46 and a lower fastener receiving hole 48 to receive a motor bolt or fastener 112 and a transom bolt or fastener 114 selectively as described hereinafter.

The substantially rectangular flat adapter mounting plate 20 includes an upper set or pair of apertures generally indicated as 54 and a lower set or pair of apertures generally indicated as 56. The upper set or pair of apertures 54 and the lower set or pair of apertures 56 each comprises an upper fastener receiving hole 58 and a lower fastener receiving hole 60.

The side-mount accessory adapter 12 comprises a substantially rectangular flat proximal side-mount adapter mounting plate 62 including an upper substantially vertical slot 66 formed therethrough to receive an adapter bolt or fastener 68 extending through the lower fastener receiving hole 60 of the upper set or pair of apertures 54 and the lower set or pair of apertures 56 formed through the substantially rectangular flat adapter mounting plate 20 to secure the side-mount accessory adapter 12 to the substantially rectangular flat adapter mounting plate 20 of the outboard motor mount 10 and a substantially rectangular flat distal accessory mounting plate 70 including at least one accessory mounting aperture 72 formed therethrough to attach or mount an accessory (not shown) to the side-mount accessory adapter 12 coupled together by an interconnecting member generally indicated as 74 including a substantially rectangular flat proximal coupling plate 76 and a substantially rectangular flat distal coupling plate 78 inclined relative to each other. The substantially rectangular flat proximal coupling plate 76 is angularly inclined relative to the substantially rectangular rectangular flat proximal side-mount adapter mounting plate 62 and the substantially rectangular flat distal coupling plate 78 is angularly inclined relative to the substantially rectangular flat distal side-mount adapter mounting plate 70.

Figure 4:
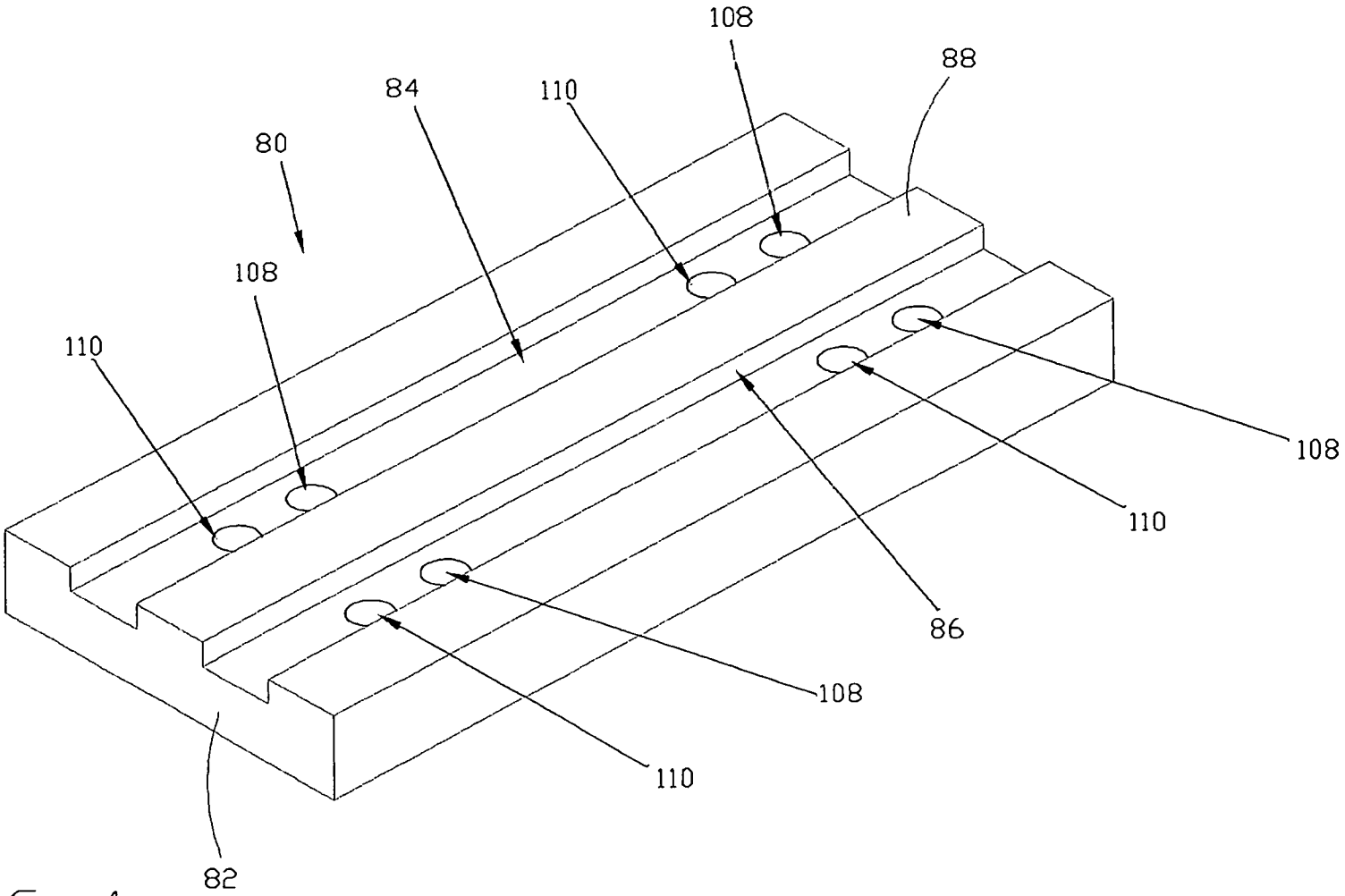
FIG. 4 is a perspective view of the adapter plate shim of the present invention.
Figure 5:
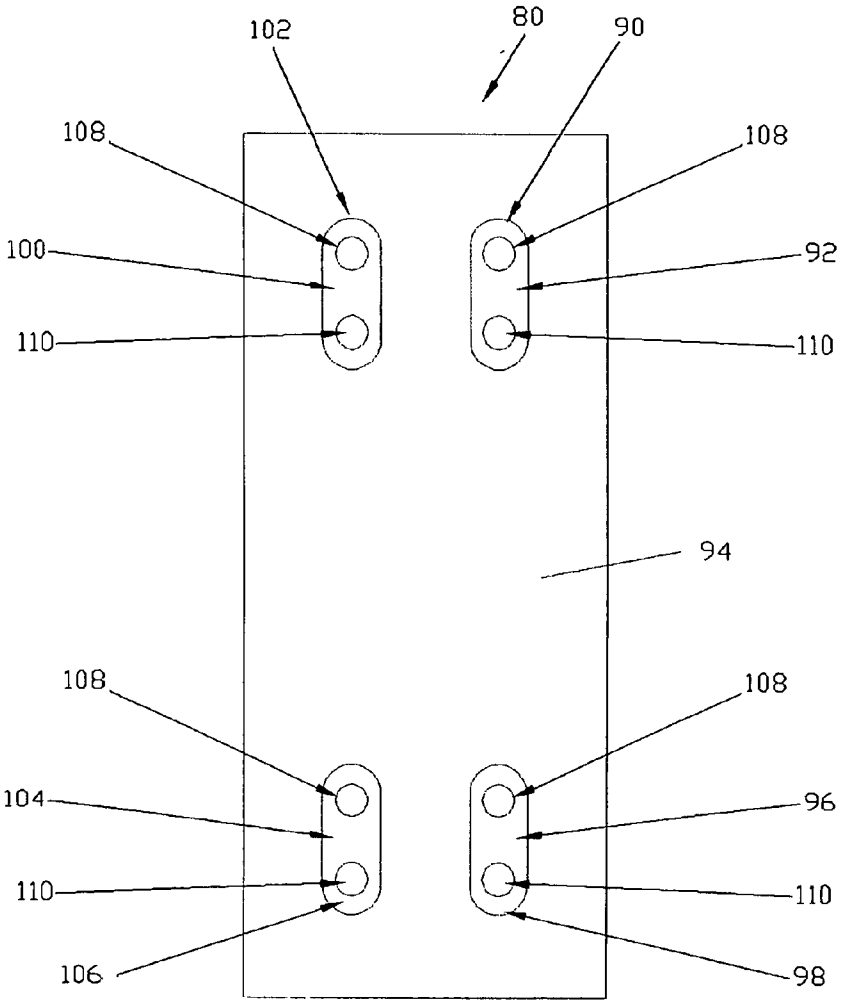
FIG. 5 is a front view of the adapter plate shim of the present invention.

As shown in FIGS. 4 and 5, an adapter plate shim generally indicated as 80 may be used to mount the opposite side of the outboard motor 14 to the transom 16 when only a single outboard motor mount and side-mount accessory adapter 12 are used. The adapter plate shim 80 comprises a substantially rectangular flat transom mounting plate 82 including a first and second substantially parallel longitudinally disposal groove indicated as 84 and 86 respectively formed on the inner surface 88 thereof.

A first upper set or pair of countersunk apertures generally indicated as 90 disposed within a substantially oval recess 92 formed in the outer surface 94 of the substantially rectangular flat transom mounting plate 80 and a first lower set or pair of countersunk apertures generally indicated as 96 disposed within a substantially oval first lower recess 98 formed in the outer surface 94 of the substantially rectangular mounting plate 80 are disposed in substantially vertical alignment relative to each other.

A second upper set or pair of countersunk apertures generally indicated as 100 disposed within a substantially oval second upper recess 102 formed in the outer surface 94 of the substantially flat rectangular transom mounting plate 80 and a second lower set or pair of apertures generally indicated as 104 disposed within a substantially oval second lower recess 106 formed in the outer surface 94 of the substantially rectangular mounting plate 80 are disposed substantially vertical alignment relative to each other.

Each set or pair of countersunk apertures 90, 96, 100 and 104 comprises an upper fastener receiving hole 108 and a lower fastener receiving hole 110 to receive a outboard motor bolt or fastener 112 and a transom bolt or fastener 114 respectively therethrough.

Prior to installation, the proper length bolts or fasteners 112 needed to secure the outboard motor 14 and the side-mount accessory adapter 12 together are placed in the first substantially parallel longitudinally disposed grooves 22 and 24 through the upper fastener receiving holes 46 of the first upper set or pair of countersunk apertures 28 of the substantially oval first upper recess 30 and of the second lower set or pair of countersunk apertures 42 of the substantially oval second lower recess 44. The side-mount accessory adapter 12 is then affixed to the transom 16 with a separate set of bolts or fasteners 114 placed through the lower fastener receiving holes 48 of the first upper set or pair of countersunk apertures 28 substantially oval first upper recess 30 and of the second lower set or pair of countersunk apertures 42 of the substantially oval second lower recess 44 utilizing the predrilled mounting hole pattern in outboard motor 14. Finally, the substantially rectangular flat proximal side-mount adapter mounting plate 62 of the side-mount accessory adapter 12 is fastened to the substantially rectangular flat adapter mounting plate 20 of the outboard motor mount 10 by the fasteners 68.

The upper holes are intended for the engine bolts, while the lower bolts are for the transom bolts. Additionally, the side-mount adapter plate should use the lower bolt pattern on the flange in order to avoid interference with the engine bolts.

The figures depict a starboard mount. Of course, the outboard motor mount 10 is rotated 180 degrees for a port mount reversing the aperture and hole alignment.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An outboard motor mount and a side-mount accessory adapter to mount an outboard motor and accessory to a transom of a boat wherein said outboard motor mount comprises a transom mounting plate including an inner surface having a first and second substantially parallel longitudinally disposed grooves formed on said inner surface thereof together with a first upper set or pair of apertures and a first lower set or pair of apertures disposed in substantially vertical alignment relative to each other and said first longitudinally disposed groove to selectively receive motor fasteners and transom fasteners therethrough and a second upper set or pair of apertures and a second lower set or pair of apertures disposed in substantially vertical alignment relative to each other and said second longitudinally disposed groove to selectively receive motor fasteners and transom fasteners therethrough and an adapter mounting plate including an upper set or pair of apertures and a lower set or pair of apertures to receive selectively adapter fasteners therethrough extending outwardly from said transom mounting plate and said side-mount accessory adapter includes a proximal side-mount adapter mounting plate having an upper vertically disposed slot and a lower substantially vertical slot formed therethrough to receive adapter fasteners extending through one of said upper set or pair of apertures and one of said lower set or pair apertures formed through said adapter mounting plate in secure said side-mount accessory adapter to said adapter mounting plate and an accessory mounting plate having at least one hole formed therethrough to attach an accessory to said side-mount accessory adapter coupled or affixed to said proximal side-mount adapter mounting plate by an interconnecting member inclined relative to both said proximal side-mount adapter mounting plate and a distal accessory mounting plate.

2. An outboard motor mount and side-mount accessory adapter to mount an outboard motor and an accessory to a transom of a boat wherein said outboard motor mount includes a transom mounting plate to secure said outboard motor mount to the transom and an adapter mounting plate extending outwardly from said transom mounting plate and wherein said side-mount accessory adapter includes a proximal side-mount adapter mounting plate coupled to said adapter mounting plate and a distal accessory mounting plate coupled to said proximal side-mount adapter mounting plate to support the accessory thereon wherein said outboard motor mount comprises a substantially flat transom mounting plate including an inner surface and said adapter mounting plate comprises a substantially flat plate extending outwardly from said substantially flat transom mounting plate, said substantially flat transom mounting plate including a first and second substantially parallel longitudinally disposed groove formed on said inner surface thereof and an upper set or pair of apertures formed through said substantially flat transom mounting plate aligned with said first longitudinally disposed groove to receive fasteners therethrough to secure said outboard motor mount and said side-mount accessory adapter to the transom and a lower set or pair of apertures formed through said substantially flat transom mounting plate aligned with said second longitudinally disposed groove to receive fasteners therethrough to secure said outboard motor mount and said side-mount accessory adapter to the transom.

3. An outboard motor mount and side-mount accessory adapter to mount an outboard motor and an accessory to a transom of a boat wherein said outboard motor mount includes a transom mounting plate to secure said outboard motor mount to the transom and an adapter mounting plate extending outwardly from said transom mounting plate and wherein said side-mount accessory adapter includes a proximal side-mount adapter mounting plate coupled to said adapter mounting plate and a distal accessory mounting plate coupled to said proximal side-mount adapter mounting plate to support the accessory thereon wherein said transom mounting plate comprises a substantially flat mounting plate and said adapter mounting plate comprises a substantially flat plate, said proximal side-mount adapter mounting plate coupled to said distal accessory mounting plate by an interconnecting member and wherein said interconnecting member comprises a proximal coupling plate forming an angle with said proximal side-mount adapter mounting plate and a distal coupling plate forming an angle with said distal side-mount mounting plate.

4. The outboard motor mount and side-mount accessory adapter of claim 2 further including a second lower set or pair of apertures formed through said substantially flat transom mounting plate disposed in substantially vertical alignment relative to said upper set or pair of apertures and a second upper set or pair of apertures formed through said substantially flat transom mounting plate disposed in substantially vertical alignment relative to said lower set or pair of apertures.

5. The outboard motor mount and side-mount accessory adapter of claim 4 wherein said upper set or pair of apertures said second upper set or pair of apertures, said lower set or pair of apertures and said second set or pair of apertures are countersunk.

6. The outboard motor mount and side-mount accessory adapter of claim 2 wherein said upper set or pair of apertures, and said lower set or pair of apertures are countersunk.

7. The outboard motor mount and side-mount accessory adapter of claim 2 wherein said substantially flat adapter mounting plate includes at least one upper aperture and at least one lower aperture and said side-mount accessory adapter includes a substantially flat proximal coupling plate having an upper hole and a lower hole formed therethrough such that said upper aperture and said lower aperture are aligned with said upper hole and said lower hole respectively to receive fasteners therethrough to secure said side-mount accessory adapter to said outboard motor mount.

8. The outboard motor mount and side-mount accessory adapter of claim 7 wherein said side-mount accessory adapter comprises a proximal coupling plate to couple said side-mount accessory adapter to said outboard motor mount and a distal accessory mounting plate to mount the accessory to said side-mount accessory adapter coupled together by a interconnecting member.

9. The outboard motor mount and side-mount accessory adapter of claim 8 wherein said interconnecting member comprises a proximal coupling plate coupled to said outboard motor mount and a distal coupling plate to support the accessory inclined relative to each other.

10. The outboard motor mount and side-mount accessory adapter of claim 2 wherein said side-mount accessory adapter comprises a substantially flat proximal side-mount adapter mounting plate including an upper hole formed therethrough aligned with one of said upper set or pair of apertures and a lower hole formed therethrough aligned with one said lower set or pair of apertures to receive an adapter bolt or fastener therethrough and to secure said side-mount accessory adapter to said outboard motor mount and a substantially flat distal accessory mounting plate including at least one accessory mounting aperture formed therethrough to attach or mount the accessory to said side-mount accessory adapter.

11. The outboard motor mount and side-mount accessory adapter of claim 3 wherein said interconnecting member is angularly inclined relative to said proximal side-mount adapter mounting plate and said distal accessory mounting plate.

12. The outboard motor mount and side-mount accessory adapter of claim 3 wherein said proximal coupling plate forms an angle with said distal coupling plate.

* * * * *